US006082890A

United States Patent [19]

Heinzmann et al.

[11] Patent Number: 6,082,890

[45] Date of Patent: Jul. 4, 2000

[54] HIGH AXIAL FLOW GLASS COATED IMPELLER

[75] Inventors: Matthias Georg Heinzmann, Brombach, Germany; Wayne N. Rickman, Brockport; Philip E. McGrath, Victor, both of N.Y.

[73] Assignee: Pfaudler, Inc., Rochester, N.Y.

[21] Appl. No.: 09/275,618

[22] Filed: Mar. 24, 1999

[51] Int. Cl.[7] ..... B01F 7/22

[52] U.S. Cl. ..... 366/330.3; 366/330.4; 416/241 R

[58] Field of Search ..... 366/102–104, 366/262–263, 265, 270, 292, 330.1, 330.3, 330.4, 330.5, 330.7, 342, 343; 261/84, 93; 416/197 R, 197 B, 198 R, 175, 234, 241 R, 243, DIG. 5

[56] References Cited

U.S. PATENT DOCUMENTS

| | | | |
|---|---|---|---|
| Re. 35,625 | 10/1997 | Roberts . | |
| D. 262,791 | 1/1982 | Piarulli et al. . | |
| 3,307,634 | 3/1967 | Bihlmire . | |
| 3,494,708 | 2/1970 | Nunlist et al. . | |
| 3,775,164 | 11/1973 | Smith et al. . | |
| 3,788,874 | 1/1974 | Crandall et al. . | |
| 4,213,713 | 7/1980 | Kaessner et al. | 366/279 |
| 4,221,488 | 9/1980 | Nunlist et al. | 366/343 |
| 4,264,215 | 4/1981 | Nunlist et al. | 366/279 |
| 4,314,396 | 2/1982 | Nunlist et al. . | |
| 4,508,455 | 4/1985 | Lerman et al. . | |
| 4,571,090 | 2/1986 | Weetman et al. . | |
| 4,601,583 | 7/1986 | Amorese | 366/343 |
| 4,606,103 | 8/1986 | Koehl et al. . | |
| 4,721,394 | 1/1988 | Casto et al. | 366/343 |
| 4,882,098 | 11/1989 | Weetman | 366/102 |
| 4,896,971 | 1/1990 | Weetman et al. | 261/84 |
| 5,112,192 | 5/1992 | Weetman | 416/243 |
| 5,297,938 | 3/1994 | Von Essen et al. | 366/330.3 |
| 5,316,443 | 5/1994 | Smith | 366/330.1 |
| 5,813,837 | 9/1998 | Yamamoto et al. | 366/330.3 |
| 5,951,162 | 9/1999 | Weetman et al. | 416/DIG. 5 |

OTHER PUBLICATIONS

Chemineer, Inc. Agitators & Mixers Publication, Bulletin 712, 1996.

*Primary Examiner*—Charles E. Cooley
*Attorney, Agent, or Firm*—Michael L. Dunn

[57] ABSTRACT

A glass coated high axial flow impeller, including a hub and attached blades. The hub has a centrally located hole, where the hole has a central axis. The impeller has a plurality of angles and edges, all of which have a rounded configuration to permit glassing. The impeller further includes at least two variable pitch blades. Each blade has front and rear surfaces both defined by an inside edge having a leading end and a trailing end, an outside edge having a leading end and a trailing end, a leading edge connecting the leading end of the inside edge to the leading end of the outside edge and a trailing edge that connects the trailing end of the inside edge to the trailing end of the outside edge. The outside edge of each blade is from about 1.5 to 2.5 times the length of the inside edge. The blades are symmetrically attached to the hub at their inside edges; so that, their inside edges are at an angle of from about 45 to about 60 degrees from the central axis of the attached hub and their outside edges are at an angle of from about 50 to about 70 degrees from the central axis of said hub. The angle of the inside edges to the central axis of said hub is from about 6 to about 12 degrees less than the angle of the outside edges to the central axis. The hub and its attached blades are covered by a contiguous coating of glass.

20 Claims, 6 Drawing Sheets

HIGH AXIAL FLOW GLASS COATED IMPELLER

BACKGROUND OF THE INVENTION

This invention relates to corrosion-resistant mixing impellers and more particularly relates to glass coated metal mixing impellers.

Glass coating of metal substrates is well known as, for example, described in U.S. Pat. Nos. RE 35,625; 3,775,164 and 3,788,874. Glass coated mixing impellers are also known as, for example, described in U.S. Pat. Nos. 3,494,708; 4,213,713; 4,221,488; 4,264,215; 4,314,396; 4,601,583 and D 262,791. U.S. Pat. No. 4,601,583 describes glass-coated impellers fitted to a shaft by means of cryogenic cooling to obtain a very tight friction fit. The impellers are dual hub impellers, i.e. two hubs, each carrying two blades. The hubs are placed proximate each other on the shaft so that the blades are oriented 90 degrees to each other about the shaft. The patent also shows multiple impellers spaced from each other upon the shaft, known as a "dual flight" configuration.

Despite it being known that certain glass-coated impellers could be placed upon a shaft, there has been no good glass coated high axial flow impeller available. Such a high axial flow impeller would be desirable to be able to quickly obtain vertical flow to assure quick mixing of an entire tank without concern about separate layering that can occur when only radial flow, e.g. turbine type, impellers are used. U.S. Pat. No. 4,601,583 discloses an impeller having axial flow properties but the axial flow output as measured by its axial flow number is not nearly as good as desired.

High axial flow impellers have been known in metal non-glass coated configurations, e.g. in the form of propellers as commonly found on boats. It was believed that glass coated configurations of those same high flow impellers could not be manufactured because such high axial flow metal impellers have many angles and edges that are generally believed to prevent effective glass coating.

BRIEF DESCRIPTION OF THE INVENTION

Figure 1:
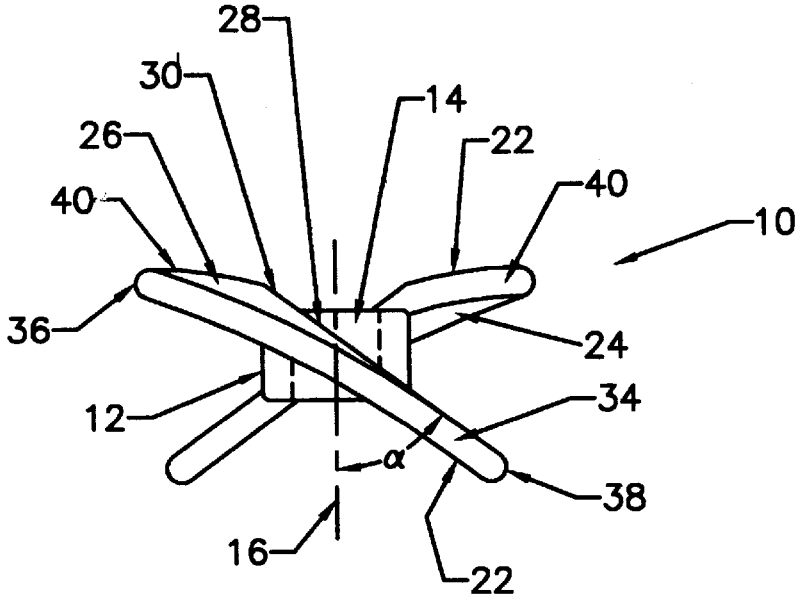
FIG. 1 shows an end view of a two bladed impeller in accordance with the invention.
Figure 2:
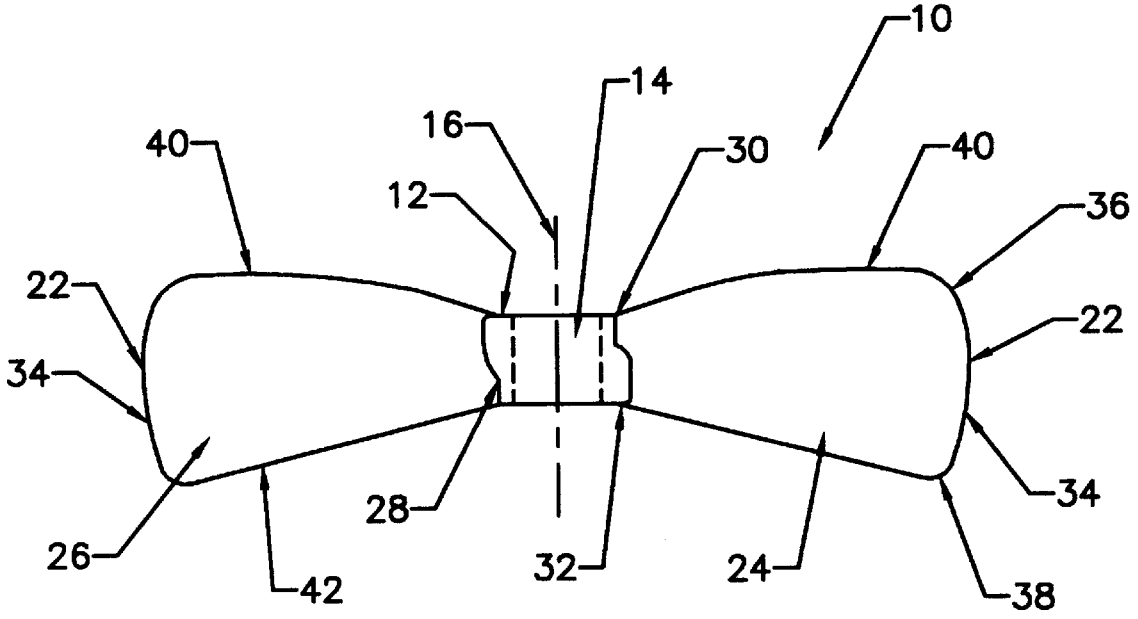
FIG. 2 shows a side view of the impeller of FIG. 1.

In accordance with the invention, it has now been discovered that a high axial flow impeller can be designed and glass coated and, if desired, be assembled in a dual hub format.

The invention therefore comprises a glass coated high axial flow impeller, comprising a hub and attached blades. The hub has a centrally located hole, where the hole has a central axis that is sized for passage over a drive shaft. The drive shaft has a longitudinal axis so that when the hole is placed over the shaft, the central axis of the centrally located hole corresponds with the longitudinal axis of the shaft. The impeller has a plurality of angles and edges, all of which have a rounded configuration to permit glassing without cracking, delaminating or significant crazing. The impeller further includes at least two variable pitch blades. Each blade has front and rear surfaces both defined by an inside edge having a leading end and a trailing end, an outside edge having a leading end and a trailing end, a leading edge connecting the leading end of the inside edge to the leading end of the outside edge and a trailing edge that connects the trailing end of the inside edge to the trailing end of the outside edge. "Leading edge", as used herein, means the edge that first contacts and displaces fluid when the impeller is rotated in the fluid. "Trailing edge" means the edge that last contacts the fluid as the impeller is rotated.

An important part of the invention is that the outside edge of each blade is from about 1.5 to 2.5 times the length of the inside edge. This difference in length of inside and outside edges contributes significantly to the high flow characteristics of the impeller of the invention. Unfortunately, that difference could give rise to unusual angles and corners. Such angles and comers are believed to be a contributing factor in the prior art belief that such impeller configurations were not practically subject to glass coating. In accordance with the present invention, such sharp angles and comers are rounded prior to glassing. The blades are symmetrically attached to the hub at their inside edges; so that, their inside edges are at an angle of from about 45 to about 60 degrees from the central axis of the attached hub and their outside edges are at an angle of from about 50 to about 70 degrees from the central axis of said hub. In all cases; however, the angle of the inside edges to the central axis of said hub is from about 6 to about 12 degrees less and preferably from about 7 to about 9 degrees less than the angle of the outside edges to the central axis. The hub and its attached blades are covered by a contiguous coating of glass.

DETAILED DESCRIPTION OF THE INVENTION

The impellers of the invention are glass coated by means known to those skilled in the art. In general, the metal substrate is cleaned, coated with a glass frit formulation and fired.

"Axial flow" as used herein means flow in a direction parallel to the central axis of the impeller. Axial flow can be characterized by the flow number (Fn). Fn is defined as $Q/(rpm \times D^3)$, where Q is the pumping capacity of the turbine, rpm is the rotational velocity of the turbine and D is the diameter of the turbine. In practice the rpm and diameter D of the turbine is known. The pumping volume, at a known rpm and turbine diameter, is then measured, e.g. by laser flow measurement where the velocity of particles suspended in a fluid is measured through a given area. The flow number may then be calculated. Once known, the flow number for a particular turbine configuration may then be used to determine pumping volume for various diameters of the turbine at various rpm. Impellers having high flow numbers have a higher pumping volume than impellers with lower numbers at the same rotational speed and impeller diameter.

The impellers of the invention are usually glass-coated metals. The metal is usually low carbon steel or a corrosion resistant alloy such as stainless steel. The turbine may be formed by any suitable means, e.g. by welding blades to a hub or by casing or forging the entire impeller as one piece. In all cases angles are rounded to reduce stress upon later applied glass coatings. In forming the glass coating, usually multiple glass applications are used, e.g. two ground coats followed by four cover coats.

The hub of the impeller has a hole through the center that is sized to slide over a drive shaft to form an integral mixing unit. The impeller can be retained on the shaft by friction fit or by other means such as clamping means or screw joints.

The hub of the impeller has a hole through the center that is glass coated. The surface defining the hole is preferably honed to close tolerances for friction fit to a drive shaft, e.g. by cooling the shaft cryogenically to shrink its diameter followed by sliding the hub over the shaft. Upon cooling, the shaft expands to securely hold the impeller to the shaft by friction fit to form an integral mixing unit (combined shaft and impeller).

The mixing unit may comprise at least two impellers, each of which is secured to the drive shaft by fit of the drive shaft through holes in the hubs of the impellers. In accordance with the invention, at least one of the impellers is a high axial flow impeller in accordance with the invention.

The mixing unit may, for example, comprise a combination of at least two high flow impellers of the invention to effectively form a high axial flow impeller having four blades. In such a case, each of the impellers is assembled to and secured to the drive shaft by fitting of the drive shaft through the central holes in the hubs of the impellers. The blades of a first of the impellers are rotated from about 30 to about 90 degrees about the longitudinal axis of the shaft, relative to orientation of the blades of a second impeller. Additionally, the hubs of the first and second impellers are proximate each other, i.e. they are directly in contact or separated by a short distance that is usually less than the thickness of a single hub. In such a configuration, the attachments of the blades of one of the impellers to the hub may be offset so that leading edges of the blades of both the first and second impellers lie in a same plane.

In accordance with the invention, the combination of the first and second impellers has a flow number of from about 0.75 to about 0.85. The combined impellers may be on a shaft with additional impellers, e.g. a curved blade or flat blade turbine impeller. In such a case, the "additional" impeller is usually near the bottom of a tank or other container and the combined impellers of the invention are nearer the top of the tank or other container. In that configuration, the high flow impellers of the invention force fluid to the bottom of the tank and the turbine directs the fluid radially. The fluid then flows upwardly and back to the impellers of the invention. In this way, very effective vertical agitation is achieved and layering is avoided.

The invention may be better understood by reference to the drawings illustrating preferred embodiments of the invention. It is to be understood that the illustrated embodiments are for the purpose of illustrating, not limiting, the present invention.

As seen in the drawings, glass coated axial flow impeller 10 has a hub 12 with a centrally located hole 14 having a central axis 16. The hole is sized for passage over a shaft 18 having a longitudinal axis 20 so that the central axis 16 of hole 14 corresponds with the longitudinal axis 20 of shaft 18. The impeller has at least two variable pitch blades 22. Each blade 22 has a front surface 24 and a rear surface 26 both defined by an inside edge 28 having a leading end 30 and a trailing end 32 and by an outside edge 34 having a leading end 36 and a trailing end 38. Front and rear surfaces 24 and 26 are further defined by leading edge 40 that connects leading end 30 of inside edge 28 with leading end 36 of outside edge 34 and by trailing edge 42 that connects trailing end 32 of inside edge 28 with trailing end 38 of outside edge 34. The blades are symmetrically attached to the hub at inside edges 28 so that the inside edges 28 are at an angle $\alpha$ of from about 45 to about 60 degrees from central axis 16 of hub 12 and so that outside edges 34 are at an angle $\beta$ of from about 50 to about 70 degrees from the central axis 16 of hub 12. The entire impeller 10 including hub 12 and attached blades 22 are covered with a contiguous coating of glass 44. The impeller has a plurality of angles and edges, e.g. 28, 34, 40, 42, $\alpha$, and $\beta$ all of which have a rounded configuration to assist in forming a durable and stable glass coating.

Figure 5:
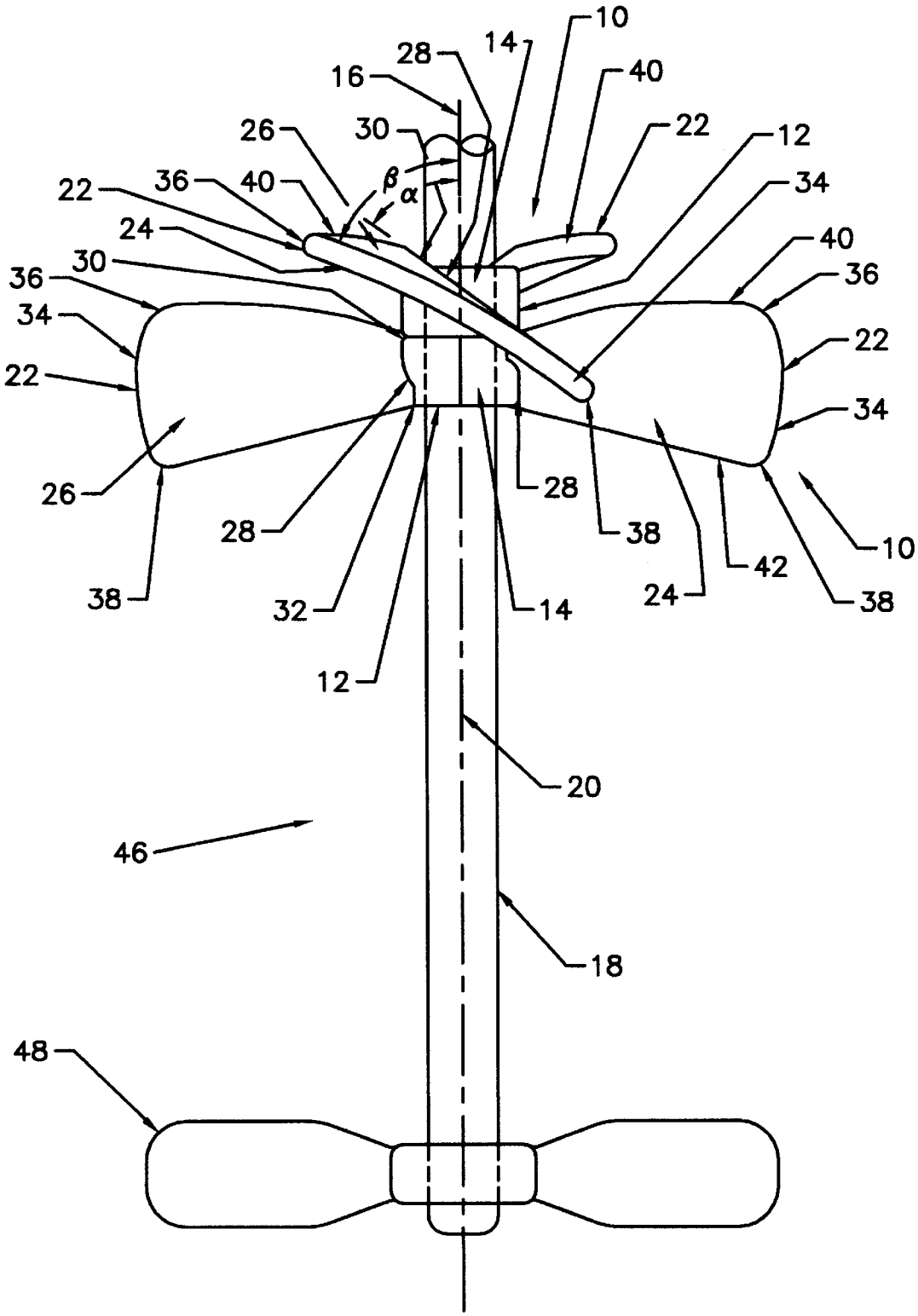
FIG. 5 shows an elevational view of a mixing unit of the invention showing two turbines of the invention mounted proximate each other on an upper portion of a shaft and a turbine type impeller mounted on a lower portion of the shaft.

As best seen in FIG. 5, at least two impellers 10 may be secured to drive shaft 18 by fit of the drive shaft through holes 14 in the hubs 12 of the impellers to form a mixing unit. At least one of the impellers is a high axial flow impeller as previously described.

A mixing unit 46 may be formed as seen in FIG. 5, which comprises at least two impellers as previously described, each of which is assembled to and secured to the drive shaft 18 through central holes 14 in hubs 12 of impellers 10. In such a case the blades of a first impeller are desirably rotated from about 30 to about 90 degrees about longitudinal axis 20 of shaft 18 relative to orientation of the blades of the second impeller. The hubs of the two impellers may be proximate each other to effectively form a combination impeller having four blades. "Proximate each other", as used in this context, means that the hubs 12 of the impellers 10, are arranged so that at least a portion of the blades 22 of at least one of the impellers operates in a same rotational plane about the shaft 18 as at least a portion of the blades of the other impeller.

As seen in FIG. 5, the impellers of the invention may be combined on a shaft with other impellers that are the same or different than the impeller of the invention. The mixing unit 46 shown in FIG. 5 comprises two upper impellers 10 of the invention and a lower impeller 48 in the form of a flat blade turbine.

Figure 6:
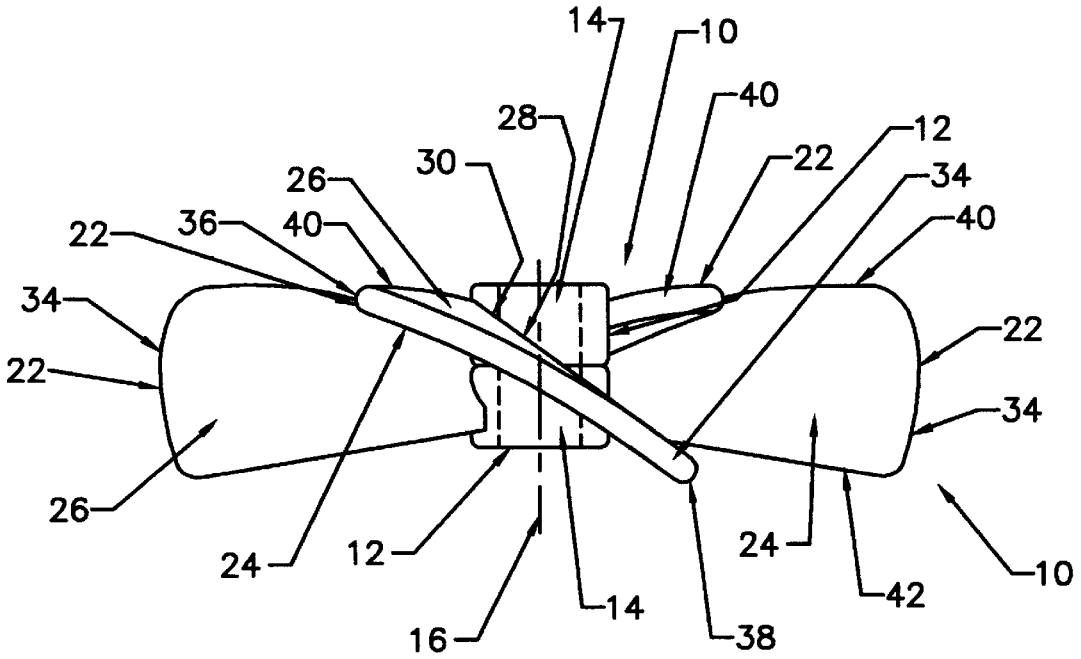
FIG. 6 shows two turbines of the invention having offset blades so that the blades operate in the same radial planes about a shaft.

As seen in FIG. 6, the blades of impellers of the invention may be offset so that when two impellers are mounted so that their hubs 12 are proximate each other, the leading edges 40 of blades 22 of both impellers, operate in essentially the same rotational planes about the shaft.

Figure 3:
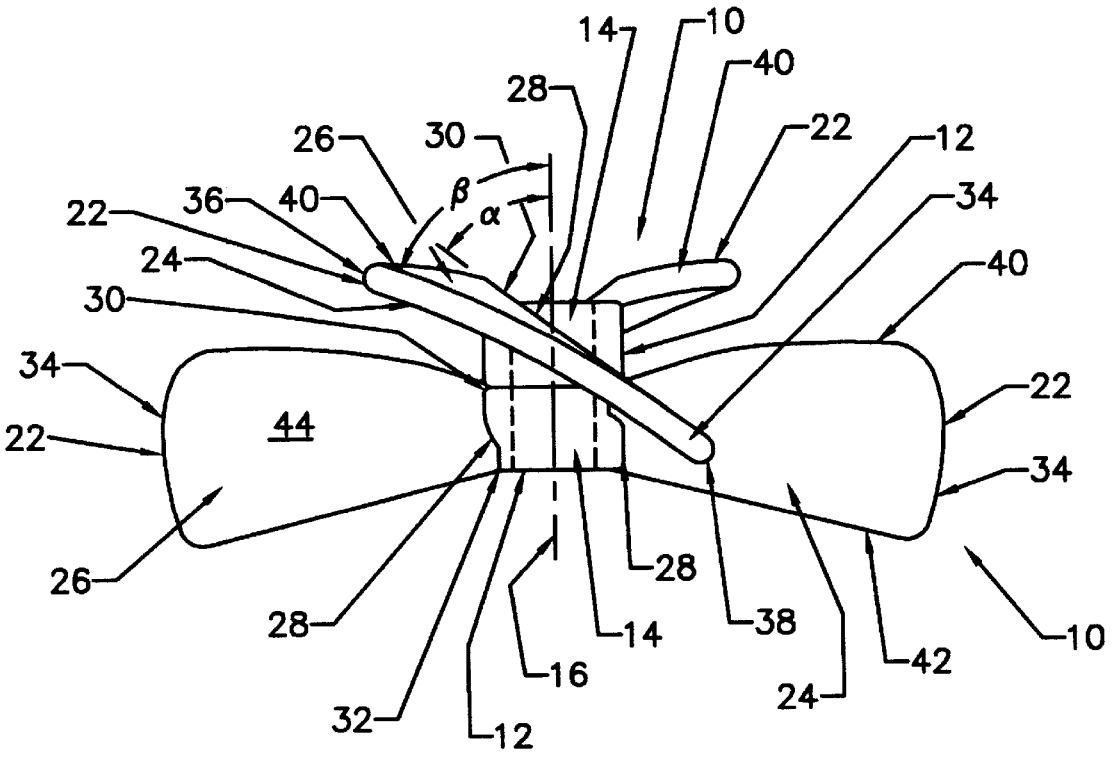
FIG. 3 shows a side view of two, two bladed turbines of the invention as they would appear if mounted in a 90 degree orientation from each other upon a shaft.
Figure 4:
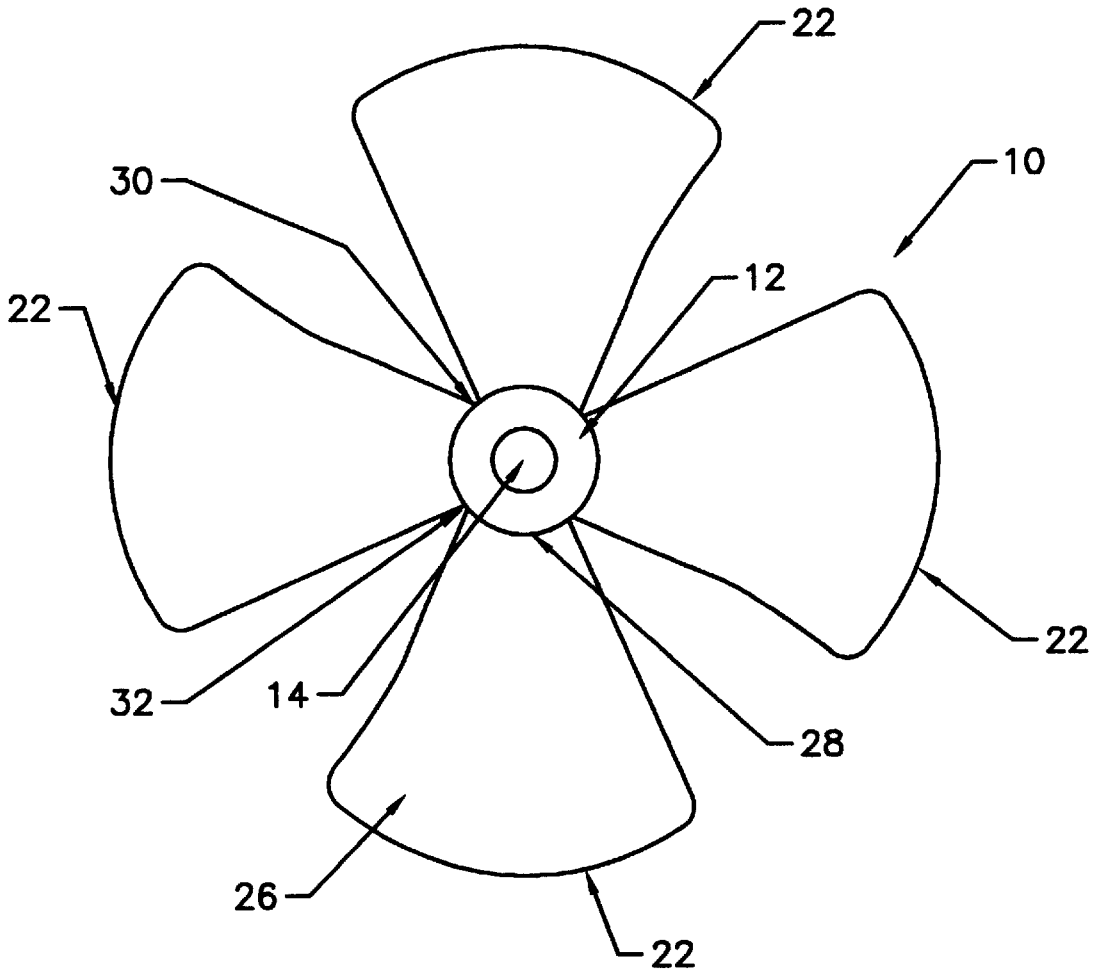
FIG. 4 shows a top view of two, two bladed turbines of the invention as they would appear mounted in a 90-degree orientation from each other upon a shaft.
Figure 7:
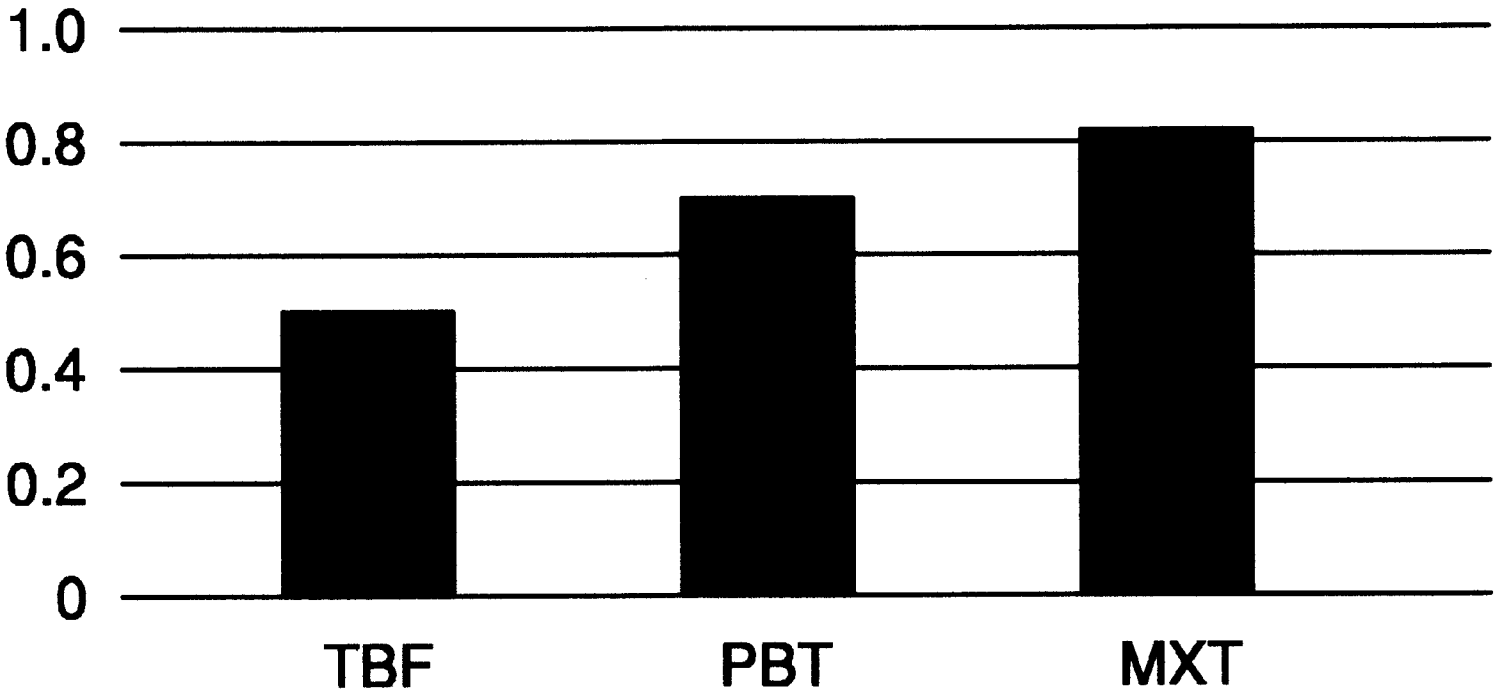
FIG. 7 shows a graph comparing flow numbers of the impeller of the invention with the flow numbers of known impellers having axial flow characteristics.

Impellers of the invention in a configuration essentially as shown in FIG. 3 were tested to determine the axial flow number Fn by measuring axial flow from the impeller using as laser to measure flow of suspended particles in a turbulent low viscosity fluid. The results were compared with a known turbofoil (TBF) type impeller and with a known pitch blade turbine (PBT) impeller essentially as shown in FIG. 5*a* of U.S. Pat. No. 4,601,583. All impellers had essentially the same diameter and had four blade configurations and were rotated at the same speed. The impeller configuration of the invention had a flow number of about 0.81. The pitch blade turbine had a flow number of about 0.65 and the turbofoil impeller had a flow number of about 0.45. These numbers show that the impeller of the invention provides much greater flow than either the turbofoil or pitch blade turbine impellers which, prior to the present invention were the only available glass-coated impellers providing any significant radial flow. The results are illustrated by the graph in FIG. 7. The numbers on the Y axis of the graph indicate the flow number as calculated using the formula previously described.

What is claimed is:

1. A glass coated axial flow impeller, said impeller comprising a hub, having a centrally located hole, said hole having a central axis, said hole being sized for passage over a drive shaft having a longitudinal axis so that the central axis of the centrally located hole corresponds with the longitudinal axis of the shaft, said impeller having a plurality of angles and edges, all of which have a rounded configuration, said impeller further comprising at least two variable pitch blades, each blade having front and rear surfaces both defined by an inside edge having a leading end and a trailing end, an outside edge having a leading end and a trailing end, a leading edge connecting the leading end of the inside edge to the leading end of the outside edge and a trailing edge that connects the trailing end of the inside edge to the trailing end of the outside edge, said outside edge of each blade being from about 1.5 to 2.5 times the length of the inside edge, said blades being symmetrically attached to said hub at their inside edges so that the inside edges are at an angle of from about 45 to about 60 degrees from the central axis of the attached hub and their outside edges are at an angle of from about 50 to about 70 degrees from the central axis of said hub; provided that, the angle of the inside edges to the central axis of said hub is from about 6 to about 12 degrees less than the angle of the outside edges to the central axis of said hub, said hub and its attached blades being covered by a contiguous coating of glass.

2. The impeller of claim 1 wherein the angle of the inside edges to the central axis of said hub is from about 7 to about 9 degrees less than the angle of the outside edges to the central axis of said hub.

3. The impeller of claim 2 wherein the impeller comprises glass coated steel.

4. The impeller of claim 3 wherein the steel is a stainless steel.

5. A mixing unit comprising the impeller of claim 2 secured to the drive shaft by fit of the drive shaft through the hole in the hub.

6. The mixing unit of claim 5 wherein the impeller is secured to the drive shaft by a friction fit.

7. The mixing unit of claim 6 wherein the drive shaft comprises glass coated stainless steel.

8. The mixing unit of claim 5 wherein the drive shaft comprises glass coated steel.

9. A mixing unit comprising at least two impellers, each of which is secured to the drive shaft by fit of the drive shaft through holes in the hubs of the impellers, at least one of the impellers being an impeller as described in claim 2.

10. A mixing unit comprising a combination of at least two of the impellers, as described in claim 2, each of which is assembled to and secured to the drive shaft by fit of the drive shaft through the central holes in the hubs of the impellers, wherein the blades of a first impeller are rotated from about 30 to about 90 degrees about the longitudinal axis of the shaft, relative to orientation of the blades of a second impeller, the hubs of the first and second impellers being proximate each other.

11. The mixing unit of claim 10 wherein the attachments of at least two of the blades to their hub are offset so that leading edges of the blades of both the first and second impellers lie in a same plane.

12. The mixing unit of claim 10 wherein the combination of the first and second impellers has a flow number of from about 0.75 to about 0.85.

13. The impeller of claim 1 wherein two of said blades are oppositely attached to said hub.

14. The impeller of claim 1 wherein the blades are attached to the hub by welding.

15. The impeller of claim 1 wherein the blades are attached to the hub by being integrally forged with the hub.

16. The impeller of claim 1 wherein the blades are attached to the hub by being integrally molded with the hub.

17. A mixing unit comprising a first impeller, as described in claim 1, mounted in an upper position on an essentially vertical shaft relative to second impeller mounted in a lower position on the shaft so that the impellers do not rotate in a same rotational plane about the shaft.

18. The mixing unit of claim 17 wherein the second impeller has a lower axial flow number than the first impeller.

19. The mixing unit of claim 18 wherein the second impeller is a flat blade turbine.

20. The mixing unit of claim 18 wherein the second impeller is a curved blade turbine.

* * * * *